US006348850B1

(12) United States Patent
Kimura et al.

(10) Patent No.: US 6,348,850 B1
(45) Date of Patent: Feb. 19, 2002

(54) COMMON MODE CHOKE COIL

(75) Inventors: Satoshi Kimura, Azuma-Mura; Manabu Takayama, Maebashi; Takashi Tajima, Gunma; Nobuyasu Shiba, Yoshii-Machi; Kinya Iri, Shibukawa; Hidenori Aoki, Tamamura-Machi, all of (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/524,564

(22) Filed: Mar. 13, 2000

(30) Foreign Application Priority Data

Mar. 16, 1999 (JP) ..... 11-069782

(51) Int. Cl.[7] ..... H01F 5/00
(52) U.S. Cl. ..... 336/200; 336/83; 336/212
(58) Field of Search ..... 336/83, 90, 96, 336/200, 232, 223, 212

(56) References Cited

U.S. PATENT DOCUMENTS 3,895,336 A * 7/1975 Pitman ..... 336/216
5,900,797 A * 5/1999 Dougauchi ..... 336/200
5,923,237 A * 7/1999 Sato et al. ..... 336/212
6,144,280 A * 11/2000 Amada et al. ..... 336/192

FOREIGN PATENT DOCUMENTS

JP 5-109548 * 4/1993
JP 5-258956 * 10/1993

* cited by examiner

*Primary Examiner*—Lincoln Donovan
*Assistant Examiner*—Tuyen T. Nguyen
(74) *Attorney, Agent, or Firm*—Townsend & Banta

(57) ABSTRACT

A common mode choke coil adapted for surface mount applications minimized in overall size (particularly in height), with an improved bonding coefficient. This common mode choke coil has a structure comprising a ferrite core consisting of a winding core and two square planar flanges with recesses formed therein, the square planar flanges being formed integrally on each end of a winding core thereof, a pair of external electrodes disposed on the square planar flanges, a plurality of windings wound about the winding core of the ferrite core and connected by thermal bonding to the external electrodes at the recesses provided in the left and right sides of each flange, and a ferrite plate adhesively bonded to the outermost surface of the windings to join the two flanges at both ends of the ferrite core, without an adhesive bonding to the flanges themselves. As a result, a closed magnetic circuit structure of a cubic component having a high rate of bonding coefficient is obtained.

6 Claims, 7 Drawing Sheets

FIG. 2(a)
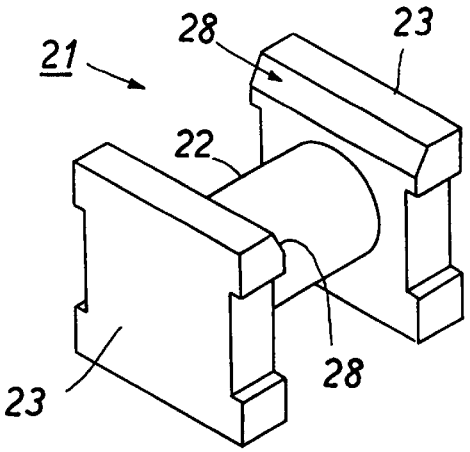
FIG. 2(b)
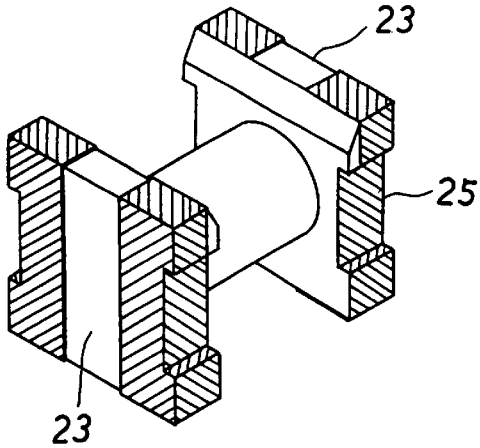
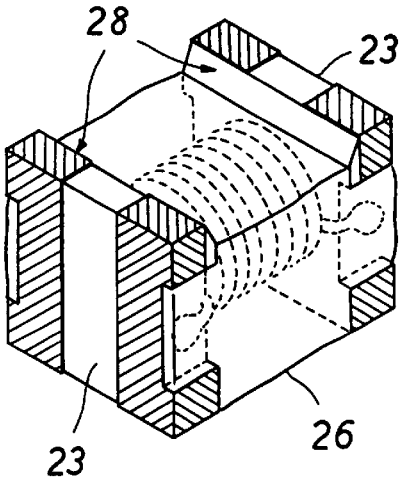
FIG. 2(d)
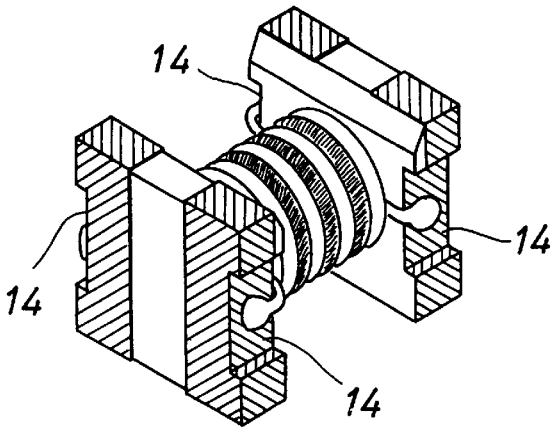
FIG. 2(c)

FIG. 4(a)
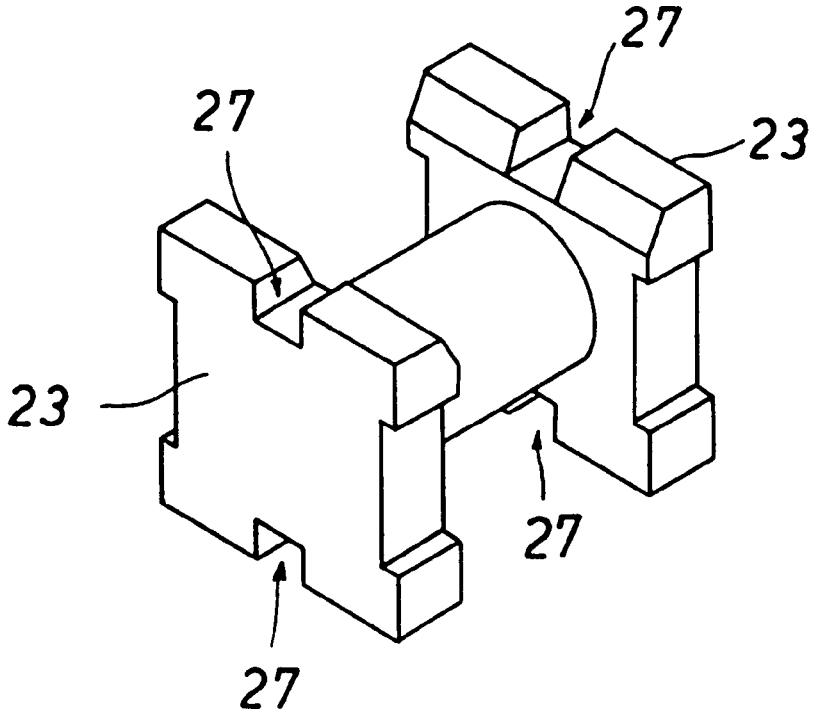
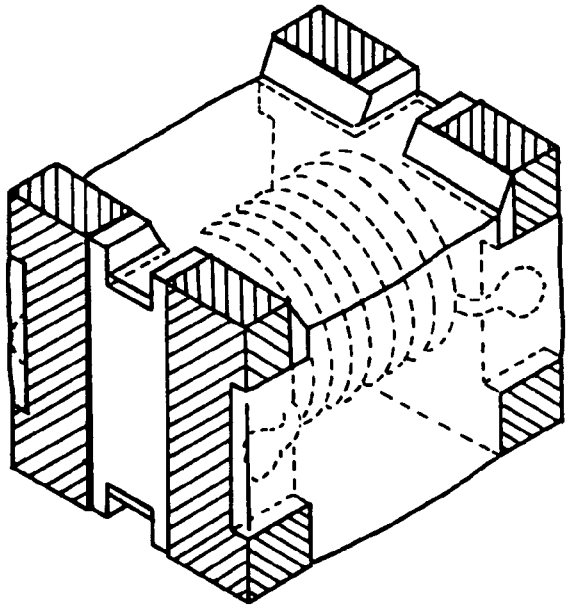
FIG. 4(b)

COMMON MODE CHOKE COIL

FIELD OF THE INVENTION

The present invention relates to a common mode choke coil adapted for surface mount applications to remove common mode noises and, particularly, to a closed magnetic circuit structure of a common mode choke coil having external electrodes joined directly to a flange of a core in order to have a higher bonding coefficient.

BACKGROUND OF THE INVENTION

For realizing a high-density surface mount package on a printed circuit board by using a chip mounter (a chip mounting apparatus), various electronic components including resistors and capacitors have been minimized in size or thickness and/or formed into a chip form. Common mode choke coils of a winding type, for attenuating noises on DC lines and unwanted radiation on secondary lines of a source or signal lines, are also provided for surface mount applications. One such choke coil is disclosed in Japanese Patent Application Laid-Open No. 8-186028 entitled "Winding Chip Inductor With Gap", wherein a common mode choke coil allows external electrodes to be joined directly to a flange of its open magnetic circuit type core, hence forming an almost-closed magnetic circuit structure.

FIGS. 6(*a*)–6(*c*) illustrates such a conventional common mode choke coil 10 wherein a core 1 of an open magnetic circuit type has a couple of flanges 3, 3 of a cross figure in cross section provided integrally on both sides a column-like winding core 2 thereof, each cross-figured flange having a lower raised portion thereof coated with a silver paste and joined directly by thermal bonding with a pair of external electrodes 5*a* and 5*c* or 5*b* and 5*d*, in which both external electrodes are further electrically connected by soldering or the like to two leads 6 and 7, respectively, which extend from the winding core 2 of the open magnetic circuit type core 1. In addition, the open magnetic circuit type core 1 is joined at the top to an I-shaped core 9 (a rectangular plate) by gap providing mediums 8.

The core 1 in the above structure is a ferrite core, which has a high resistance and can be joined directly to the external electrodes 5*a* to 5*d*.

Since the above conventional common mode choke coil 10 is not covered with resin molding as an external packaging, it can be small in size. However, tape material, liquid adhesive or a combination thereof is used as a gap forming medium 8 between the open magnetic circuit type core 1 and the I-shaped core 9. Accordingly, the gap is large, as apparent from FIG. 6(*b*), causing sufficient magnetic flux leakage to occur to cause a decline in the bonding coefficient.

Also, winding wires of the winding core are exposed but not protected with any resin molding. Thus, an electrical short-circuit or a break-down is quite likely to occur when the choke coil 10 is being handled, hence affecting the reliability of the component.

BRIEF SUMMARY OF THE INVENTION

It is an object of the present invention, in view of the foregoing aspects, to provide a smaller, more reliable common mode choke coil suitable for surface mount type chip applications incorporating a closed magnetic circuit in which the structure allows for a higher bonding coefficient.

To achieve the object of the present invention, there are provided five embodiments as follows:

In the first embodiment, a common mode choke coil is provided comprising a ferrite core having two substantially square planar flanges formed integrally on both ends of a winding core thereof, each flange joined directly with a pair of external electrodes a plurality of windings wound about the winding core of the ferrite core and connected by thermal pressure bonding to sides of the external electrodes at recesses provided in the left and right sides of each flange, and a ferrite plate bonded by an adhesive to the outermost surface of the windings to join the two flanges at both ends of the ferrite core;

In the second embodiment, a common mode choke coil is provided comprising a ferrite core having two substantially square planar flanges formed integrally on both ends of a winding core thereof, each flange joined directly with a pair of external electrodes and having beveled faces provided on the winding core side thereof facing the opposing flange, a plurality of windings wound about the winding core of the ferrite core and connected by thermal pressure bonding to sides of the external electrodes at recesses provided in the left and right sides of each flange, and a ferrite plate bonded by an adhesive to the outermost surface of the windings and tightly fitted against the beveled faces of the flanges to securely join the two flanges at both ends of the ferrite core.

In a third embodiment, a common mode choke coil is provided according to the first and second embodiments above, wherein two of the ferrite plates are attached to both left and right sides of each flange to join the two flanges at both ends of the ferrite core.

In a fourth embodiment, a common mode choke coil is provided according to embodiments one through three above, wherein the windings wound about the winding core of the ferrite core are thoroughly covered with a resin coating material, and the ferrite plate(s) are bonded to the resin packaging material to join the two flanges at both ends of the ferrite core; and In a fifth embodiment, a common mode choke coil is provided according to the fourth embodiment above, wherein each flange of the ferrite core has relief grooves provided in the sides thereof for allowing an excess of the resin coating material to flow out during the coating process.

In each of the coil structures according to the first through fifth embodiments of the present invention described above, the ferrite plate(s) joining the two flanges is electrically connected to the flanges at both ends of the ferrite core, thus yielding a closed magnetic circuit together with the winding core. Accordingly, the resultant common mode choke coil of the present invention has a higher bonding coefficient.

The coil structure of the second embodiment has an advantage over prior art structures in that the ferrite plate, at its ends, is tightly fitted against the beveled faces (slopes) of the two flanges at both ends of the ferrite core, thus allowing for smaller overall size and yielding a closed magnetic circuit. In the coil structure of the third embodiment, the ferrite plates are joined to the two, left and right, sides of the ferrite core, thus minimizing the overall height of the structure. In the coil structure of the fourth embodiment the windings are thoroughly covered with the resin packaging/coating material to develop a chip construction, thus allowing for the coil structure to be handled with ease. The coil structure called for in the fifth embodiment facilitates the packaging/coating process for covering the windings with the resin packaging/coating material.

BRIEF DESCRIPTION OF THE DRAWINGS

FIG. 2(*b*) is a perspective view of the common mode choke coil according to the second through the fourth embodiments of the present invention illustrating the second step of manufacturing thereof;

FIG. 2(*c*) is a perspective view of the common mode choke coil according to the second through the fourth embodiments of the present invention illustrating the third step of manufacturing thereof.

FIG. 2(*d*) is a perspective view of the common mode choke coil according to the second through the fourth embodiments of the present invention illustrating the fourth step of manufacturing thereof. FIG. 2(*e*) is a cross sectional view of the common mode choke coil according to the second through fourth embodiments of the present invention, illustrating the structure of the device after installation of the ferrite plate thereon.

FIG. 3(*b*) is a perspective view of the common mode choke coil shown in FIGS. 2(*a*)–3(*a*), illustrating the sixth step of manufacturing thereof.

FIG. 4(*a*) is a perspective view of the common mode choke coil according to the fifth embodiment, at the beginning of the manufacturing process thereof.

FIG. 4(*b*) is a perspective view of the completed common mode choke coil according to the fifth embodiment, showing the internal structure of the coil after coating/packing with resin.

FIG. 6(*b*) is a side view of a conventional common mode choke coil.

FIG. 6(*c*) is a front view of a conventional common mode choke coil.

DETAILED DESCRIPTION OF THE INVENTION

The five embodiments of a common mode choke coil according to the present invention will be explained below, referring to the accompanying drawings described above.

Figure 1:
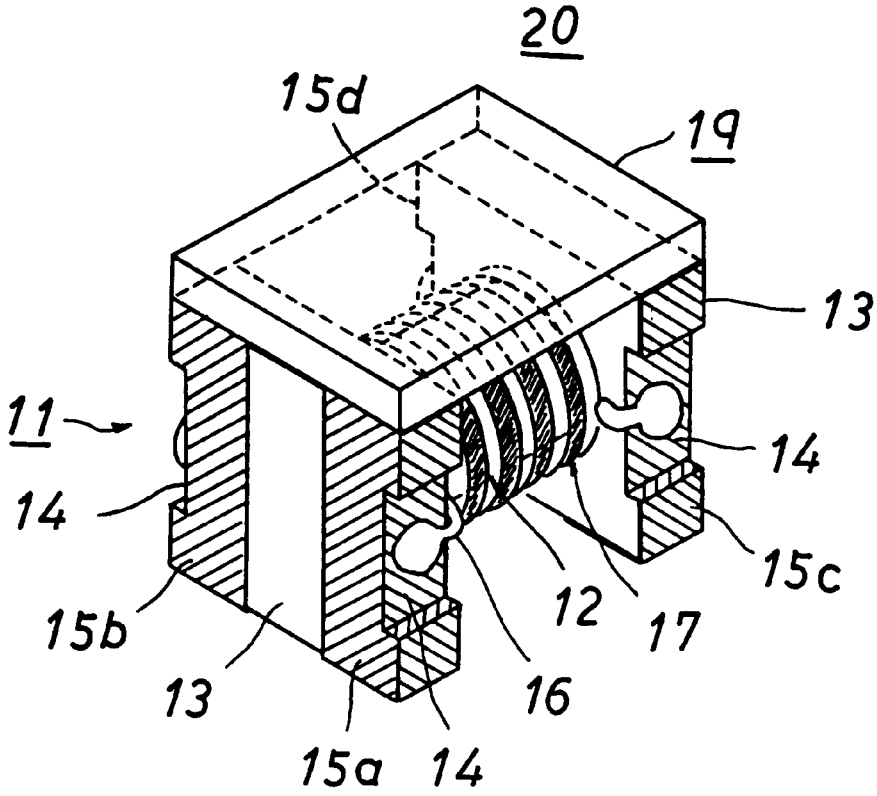
FIG. 1 is a perspective view of a common mode choke coil according to the first embodiment of the present invention.

As shown in FIG. 1, the common mode choke coil 20 of the first embodiment comprises a ferrite core 11 having two substantially square planar flanges 13, 13 formed integrally on both ends of a winding core 12 thereof. Each flange 13 is joined directly with a pair of external electrodes 15*a* and 15*b* or 15*c* and 15*d*, and a couple of windings 16 and 17 are wound about the winding core 12 of the ferrite core 11 and connected by thermal bonding to sides of the external electrodes 15*a* to 15*d* at four recesses 14 provided in the left and right sides of each flange 13. A ferrite plate 19 is bonded by an adhesive, not shown, to the outermost surface of the windings 16 and 17, and joined between the two flanges 13 and 13 at both ends of the ferrite core 11.

Unlike conventional common mode choke coils, the common mode choke coil 20 of the first embodiment of the present invention permits the ferrite plate 19 and the flanges 13 of the ferrite core 11 to be magnetically joined to one another at their ferrite surfaces with no intermediate members, hence forming a magnetically joined structure, i.e., a closed magnetic circuit structure.

Figure 6A:
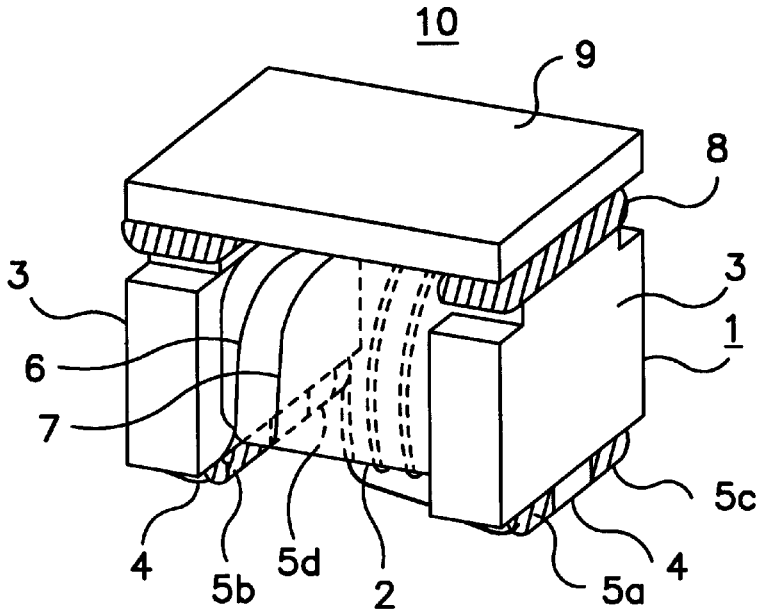
FIG. 6(a) PRIOR ART
FIG. 6(*a*) is a perspective view of a conventional common mode choke coil.
Figure 6B:
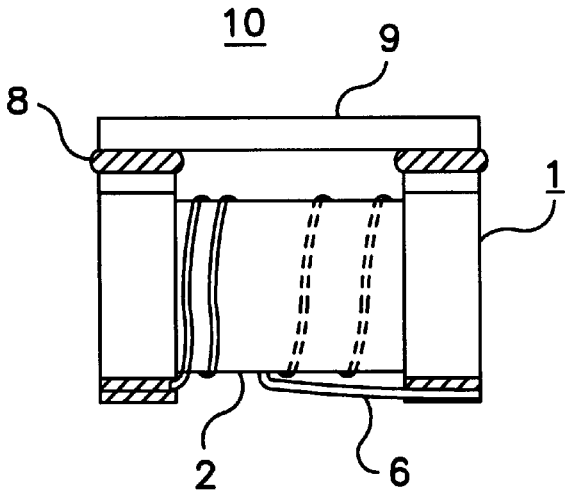
FIG. 6(b) PRIOR ART
Figure 6C:
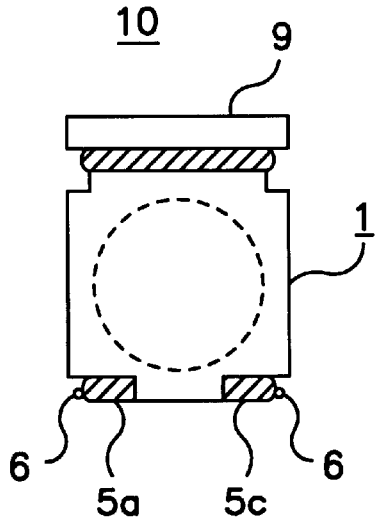
FIG. 6(c) PRIOR ART

In contrast, in the conventional common mode choke coil 10 shown in FIG. 6, the core 1 is intentionally separated from the I-shaped core 9 by the gap providing medium 8. There is little magnetic attraction between this open magnetic circuit type structure and the I-shaped core 9. Thus, a completely closed magnetic circuit structure is unobtainable by using this construction.

Moreover, the common mode choke coil 20 of the first embodiment of the present invention provides the crucial advantage of higher bonding coefficient, thus ensuring a higher degree of inductance.

In the structure of the common mode choke coil 20 shown in FIG. 1, the ferrite plate 19 is joined at both ends of its lower side to the upper ends of the two flanges 13 and 13. Accordingly, the thickness of the ferrite plate 19 adds to the overall height of the ferrite core 11.

Figure 2E:
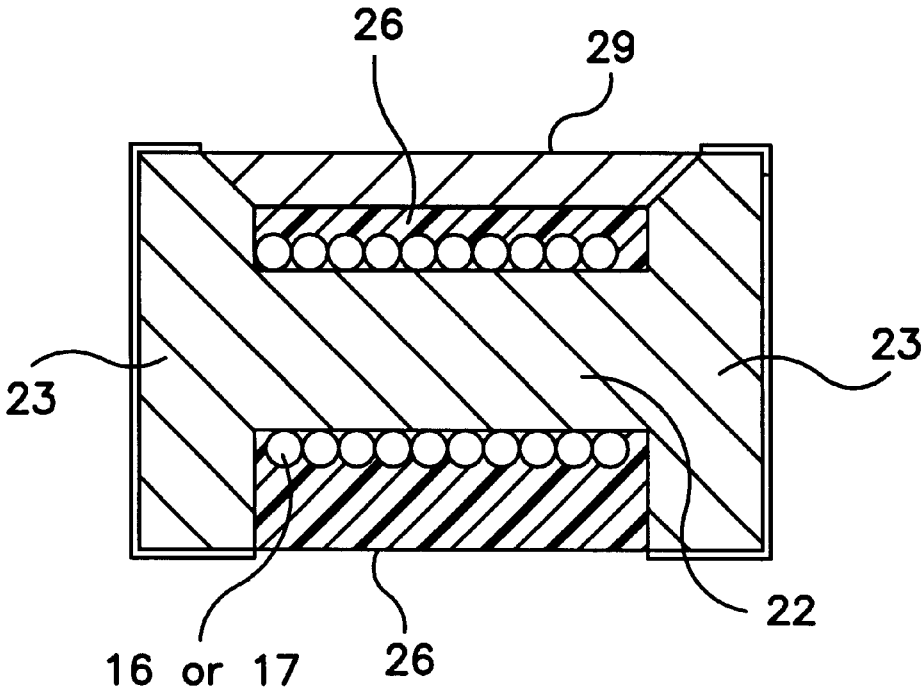
FIG. 2(*a*) is a perspective view of the common mode choke coil according to the second through the fourth embodiments of the present invention illustrating the first step of manufacturing thereof.
Figure 3A:
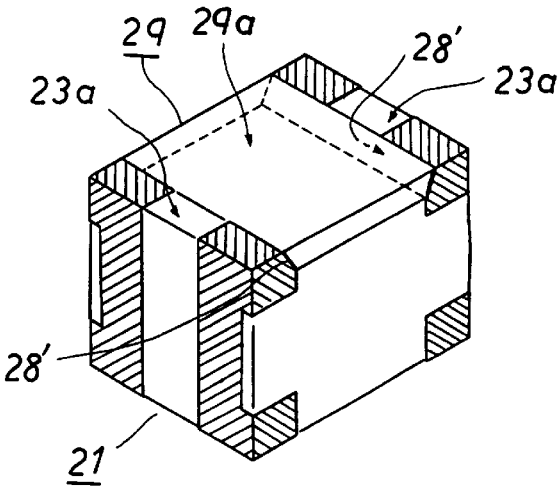
FIG. 3(*a*) is a perspective view of the common mode choke coil shown in FIGS. 2(*a*)–2(*d*), illustrating the fifth step of manufacturing thereof.
Figure 3B:
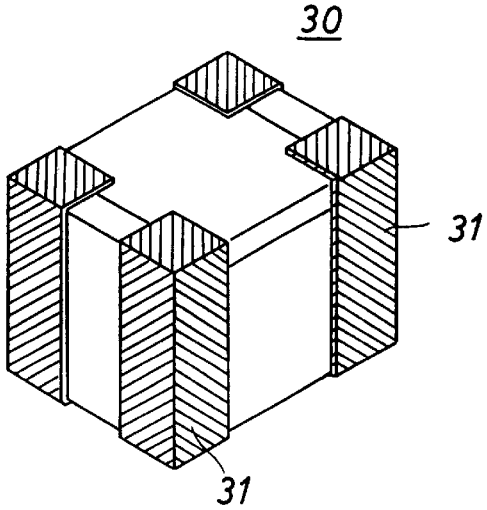

To provide a common mode choke coil with a low profile, as shown in FIGS. 2 and 3, a common mode choke coil 30 according to the second through fourth embodiments of the present invention is provided, having a modified structure adapted for minimizing the overall height. To achieve this object, each flange 23 of a ferrite core 21 has a beveled face 28 provided on a winding core side thereof which confronts the opposing flange 23 (as best shown in FIG. 2(*a*)). A ferrite plate 29 showing beveled faces 28 is provided, wherein each of the two beveled faces 28 tightly fit against the beveled face 28 of the flange 23.

As the two opposing beveled faces fit tightly against each other, the upper side 29*a* of the ferrite plate 29 becomes flush with the top 23*a* of the flange 23, hence preventing any increase in the overall height of the choke coil by the ferrite plate 29. In addition, such a structure has increased rigidity resulting from the two opposing beveled faces 28 and 28' fitting tightly against each other.

A method of manufacturing a common mode choke coil of the present invention, for instance, the coil denoted at 30, will now be described by referring to FIGS. 2(*a*)–3(*b*). The method comprises the steps of:

(1) machining a ferrite material prepared by dry molding to a column shape, or directly dry molding a ferrite core 21, (2) forming a pair of external electrodes 25 directly onto the left and right ends of each flange 23 of the ferrite core 21 by applying and heating a paste of a silver-containing resin material or the like, (3) providing windings 16 and 17 on a winding core 22 of the ferrite core 21 by any appropriate winding manner such as sectional winding, bifilar winding, overlap winding, etc., and connecting both ends of each winding by thermal pressure bonding to sides of the external electrodes 15*a* to 15*d* (denoted by the hatching) at four recesses 14 provided in the left and right sides of each flange 13, (4) coating the windings 16 and 17 of the winding core 22, and partially coating the flanges 23, with only their beveled faces 28 uncovered, with a resin packaging material 26 such as epoxy resin, phenol resin, or silicon resin, entirely packaging/coating the windings 16 and 17 of the winding core 22, (5) tightly fitting and bonding a ferrite plate 29 to the two flanges 23 of the ferrite core 21 by using the packaging resin material 26 as an adhesive or by applying a desired adhesive over the packaging resin material 26, and (6) repeating the application and heating of a packaging material to have a conductive coating over the external electrodes and, if desired, protecting the electrodes with an external electrode plating 31 (of tin, nickel, solder, or their combination).

Since the main and thermally bonded portions of the windings 16 and 17 are completely covered with the resin coating, there are no exposed portions thereof, the overall shape of the common mode choke coil 30 is substantially cube-shaped (very similar to the shape of a multi-layer choke coil), and, hence, the reliability is improved. Also, as the common mode choke coil is shaped to have upward, downward, leftward, and rightward directions (according to the fourth embodiment herein), the common mode choke coil can automatically be surface mounted using a chip mounter.

As shown in FIG. 4(*a*), each flange 23 of the ferrite core 21 may have relief grooves 27 provided in the upper and lower sides thereof for allowing excess amounts of the resin packaging material 26 to easily flow out. Thus, excess resin packaging material 26 is promptly discharged from the relief grooves 27 when having been loaded and pressurized in molds, preventing overloading on the windings 16 and 17 and on the ferrite core 21 and facilitating post-shaping after the resin packaging process.

Figure 5:
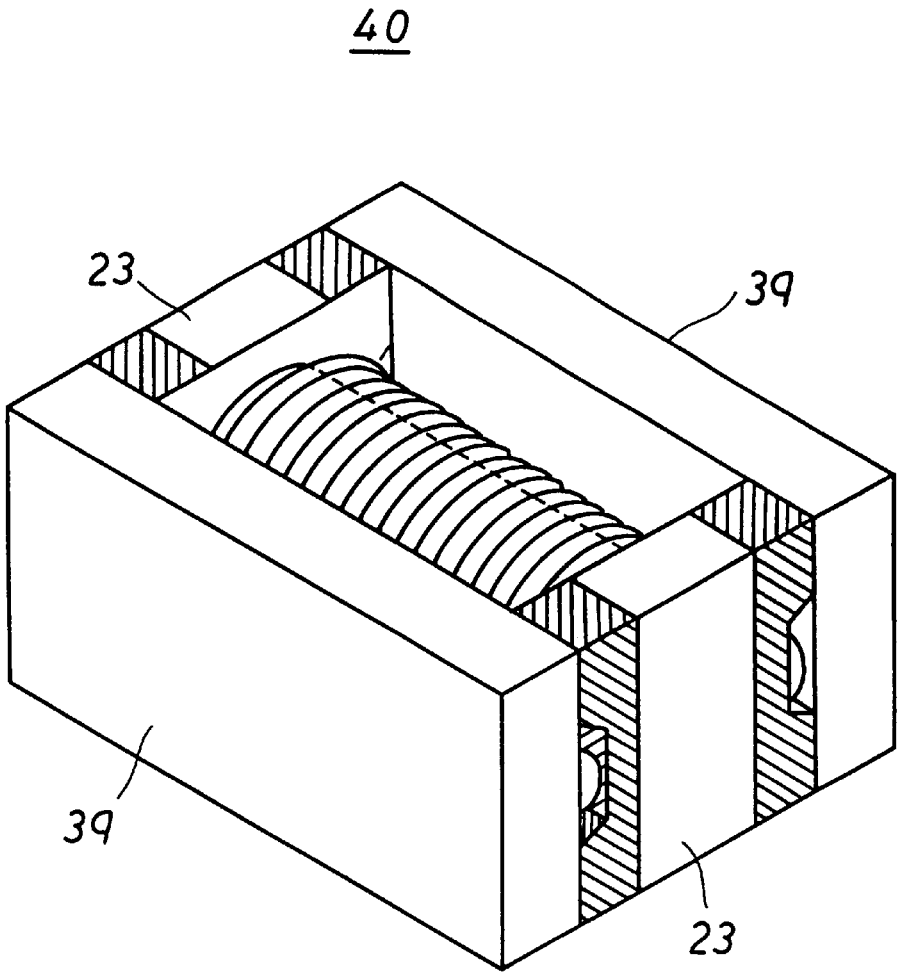
FIG. 5 is a perspective view of a common mode choke coil according to the third embodiment of the present invention.

The ferrite plate 29 joined at the ferrite core 21 in the embodiments shown in FIGS. 1 to 4(*b*) is not limited to a single plate, but rather, two or three ferrite plates may be used. FIG. 5 illustrates a common mode choke coil 40 wherein two ferrite plates 39 are bonded by an adhesive (not shown) to the windings or the resin materials, connecting the two flanges 23 at each side of the ferrite core 21. Thus, it is apparent that the common mode choke coil 40 has a smaller overall height than the common mode choke coil 30 of the previous embodiment.

As reduction of the vertical dimension is more critical than reduction of the horizontal dimension of a common mode choke coil in a typical application of surface mount technology, the common mode choke coil 40 wherein the ferrite plates 39 are provided on the two, left and right, sides is advantageous in terms of height. The two ferrite plates 39 at both the left and right sides may also provide for a better closed magnetic circuit structure, thus ensuring a higher rate of bonding coefficient. It should be understood that the common mode choke coil 40 shown in FIG. 5 need not be, but is preferably, coated with a resin packaging material.

Because of its above-mentioned characteristic structure, the common mode choke coil according to the present invention provides the following advantages:

(1) The addition of the ferrite plate(s) enhances the bonding coefficient, thus improving the inductance;

(2) The joint between the ferrite plate and the flanges formed by the tight fit between their beveled faces generates no gap, and thus contributes to the improvement of the closed magnetic circuit structure where the bonding coefficient is higher.

(3) The overall dimensions are successfully minimized, particularly with regards to height.

(4) The packaging resin material facilitates the packaging of the choke coil to a chip, hence increasing the reliability and the efficiency of the surface mounting operation; and (5) Each flange has relief grooves therein for allowing excess resin packaging material to easily flow out, thus facilitating the coating/packaging of a resin packaging material upon the common mode choke coil.

What is claimed is:

1. A common mode choke coil comprising:

a ferrite core having a winding core with a first end and a second end;

two square planar flanges, each of said square planar flanges having a left end having a recess, a right end having a recess, and a winding core side having a beveled face, each of said square planar flanges being formed integrally on each of the first and second ends of said winding core;

an external electrode formed on each of said left and right ends of both substantially square planar flanges;

a plurality of windings wound about the winding core of the ferrite core, said windings being conductively connected by thermal pressure bonding to said external electrodes at the recesses provided in the left and right sides thereof; and a ferrite plate having a first end and a second end, said ferrite plate being adhesively bonded by an adhesive or a resin packaging material to an outermost surface of the windings, and said first end and said second end thereof being fitted tightly against the beveled faces of the flanges to securely join the two flanges at both ends of the ferrite core.

2. The common mode choke coil according to claim 1, wherein two ferrite plates are provided, each of said ferrite plates being attached to each of said left and right sides of each square planar flange adjacent the recesses so as to conductively join the two square planar flanges.

3. The common mode choke coil according to claim 1, wherein the windings wound about the winding core of the ferrite core are covered with a resin packaging material, and the ferrite plate is bonded to the resin packaging material by an adhesive or the resin packaging material itself so as to join the two flanges at both ends of the ferrite core.

4. The common mode choke coil according to claim 2, wherein the windings wound about the winding core of the ferrite core are covered with a resin packaging material, and the ferrite plate is bonded to the resin packaging material by an adhesive or by the resin packaging material itself so as to join the two square planar flanges at both ends of the ferrite core without adhesively bonding the ferrite plates to the square planar flanges.

5. The common mode choke coil according to claim 3, wherein each square planar flange of the ferrite core has relief grooves provided therein between the left and right sides thereof for allowing excess resin packaging material to flow therefrom during manufacturing.

6. The common mode choke coil according to claim 4, wherein each square planar flange of the ferrite core has relief grooves provided therein between the left and right sides thereof for allowing excess resin packaging material to flow therefrom during manufacturing.

* * * * *